US009494122B2

(12) United States Patent
Tumback et al.

(10) Patent No.: US 9,494,122 B2
(45) Date of Patent: Nov. 15, 2016

(54) METHOD FOR MESHING A STARTER PINION OF A STARTING DEVICE INTO A RING GEAR OF AN INTERNAL COMBUSTION ENGINE

(71) Applicant: Robert Bosch GmbH, Stuttgart (DE)

(72) Inventors: Stefan Tumback, Stuttgart (DE); Juergen Gross, Stuttgart (DE); (Continued)

(73) Assignee: Robert Bosch GmbH, Stuttgart (DE)

( * ) Notice: Subject to any disclaimer, the term of this patent is extended or adjusted under 35 U.S.C. 154(b) by 185 days.

(21) Appl. No.: 14/369,736

(22) PCT Filed: Dec. 20, 2012

(86) PCT No.: PCT/EP2012/076266

§ 371 (c)(1),
(2) Date: Jun. 30, 2014

(87) PCT Pub. No.: WO2013/098172

PCT Pub. Date: Jul. 4, 2013

(65) Prior Publication Data

US 2014/0350829 A1 Nov. 27, 2014

(30) Foreign Application Priority Data

Dec. 30, 2011 (DE) ..... 10 2011 090 158

(51) Int. Cl.
*F02N 11/02* (2006.01)
*F02N 11/08* (2006.01)

(52) U.S. Cl.
CPC ..... *F02N 11/0851* (2013.01); *F02N 11/0855* (2013.01); *F02N 11/0844* (2013.01); (Continued)

(58) Field of Classification Search
CPC ..... F02N 11/02; F02N 11/0844; F02N 11/0851; F02N 11/0855; F02N (Continued)

(56) References Cited

U.S. PATENT DOCUMENTS

| | | | | |
|---|---|---|---|---|
| 7,275,509 | B2 * | 10/2007 | Kassner | F02N 11/0844 123/179.25 |
| 2009/0020091 | A1 * | 1/2009 | Botzenhard | F02N 11/087 123/179.3 |
| 2010/0269630 | A1 * | 10/2010 | Niimi | F02N 15/023 74/7 C |
| 2011/0056450 | A1 * | 3/2011 | Notani | F02N 11/0855 123/179.4 |

(Continued)

FOREIGN PATENT DOCUMENTS

| | | |
|---|---|---|
| CN | 101852160 | 10/2010 |
| DE | 102005021227 | 11/2006 |
| EP | 2211051 | 7/2010 |

OTHER PUBLICATIONS

International Search Report for Application No. PCT/EP2012/076266 dated Apr. 11, 2013 (English Translation, 2 pages).

*Primary Examiner* — Erick Solis
(74) *Attorney, Agent, or Firm* — Michael Best & Friedrich LLP

(57) ABSTRACT

The invention relates to a method for meshing a starter pinion (19) of a starting device (16) into a ring gear (13) of an internal combustion engine (10). The internal combustion engine (10) has a driveshaft (22), and the starting device (16) has a starter motor (25), said driveshaft (22) having a variable rotational speed (n). The internal combustion engine (10) is switched off in a method step (S1), and the starter pinion (19), which is not being rotationally driven by the starter motor (25), is then advanced in the direction of the ring gear (13) by a toe-in actuator (28) by means of a toe-in force (FV) in a method step (S2) until the starter pinion contacts the ring gear. A meshing force (FE) is then exerted onto the starter pinion (19) in a controlled manner in an additional method step (S3) in order to mesh the starter pinion (19) into a tooth gap (34) of the ring gear (13).

10 Claims, 4 Drawing Sheets

Figure 1C:
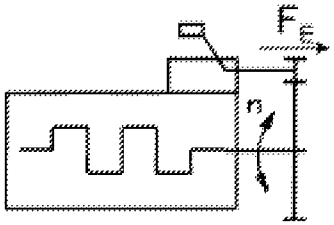

(72) Inventors: Ewald Mauritz, Weissach (DE);
Markus Roessle, Stuttgart (DE);
Matthias Cwik, Stuttgart (DE);
Apostolos Tsakiris, Ludwigsburg (DE)

(52) U.S. Cl.
CPC .... *F02N 2200/022* (2013.01); *F02N 2200/047* (2013.01); *F02N 2200/048* (2013.01); *F02N 2300/20* (2013.01); *F02N 2300/2006* (2013.01)

(58) Field of Classification Search
CPC ..... 2200/022;F02N 2200/047; F02N 2200/048
USPC ..... 701/113; 123/179.4
See application file for complete search history.

(56) References Cited

U.S. PATENT DOCUMENTS

| | | | | |
|---|---|---|---|---|
| 2011/0118962 | A1* | 5/2011 | Couetoux | F02N 11/0844 701/113 |
| 2011/0137544 | A1* | 6/2011 | Kawazu | F02N 11/0855 701/113 |
| 2011/0178695 | A1 | 7/2011 | Okumoto et al. | |
| 2011/0270512 | A1* | 11/2011 | Hayashi | F02N 11/0844 701/112 |
| 2012/0035827 | A1* | 2/2012 | Kuniyoshi | F02N 11/0855 701/102 |
| 2012/0109502 | A1* | 5/2012 | Ishikawa | F02D 17/00 701/112 |
| 2013/0133605 | A1* | 5/2013 | Neet | F02N 11/08 123/179.3 |

* cited by examiner

METHOD FOR MESHING A STARTER PINION OF A STARTING DEVICE INTO A RING GEAR OF AN INTERNAL COMBUSTION ENGINE

BACKGROUND OF THE INVENTION

Start/stop systems are known in which the internal combustion engine is switched on and off according to a certain strategy. Start/stop systems based on the pinion starters which at the start mesh a pinion in a starter ring gear of the internal combustion engine are also known.

In start/stop systems until now, the meshing of the pinion in the ring gear and the restarting of the internal combustion engines has not been able to take place until after the complete stationary state of the driveshaft or crankshaft of the internal combustion engine. As a result, in a case of stopping, delays and adverse effects of comfort occur in certain circumstances. These delays and effects are to be avoided or shortened by the meshing of the starter or the pinion thereof in the ring gear of the internal combustion engine which is coasting to a standstill. Such a sequence is also referred to in specialist circles as a "Change of Mind". This term indicates that a change of mind by the driver of the vehicle is associated with a new driving request with the need for a restarting or revving up of the internal combustion engine again.

Various strategies for energizing the starting motor and for meshing the starter pinion are known, for example, from DE 10 2008 040 830 A1. The strategies each assume a starting system in which the functions of "starting the starter motor" and "meshing the starter pinion" can occur independently of one another. The methods described herebelow specify various variants of the strategy for starting the starter motor and for meshing the starter pinion in the starter ring gear. The latter are associated with the objective of being able to use the advantages of the "Change of Mind" function also in the running down phase of the internal combustion engine after deactivation. Furthermore, decision criteria for carrying out a suitable strategy for the meshing of the starter in the internal combustion engine which is coasting to a standstill are specified. This is done in such a way that the primary objectives are satisfied in the best possible way for the respective application. These primary objectives include, for example, the so-called restarting period, reduction of vibrations when starting with the vehicle, reduction of noise and increasing the service life of the starting system.

Basically two aspects have to be taken into account for the selection of the meshing strategy:

On the one hand the co-ordination between the reduction in vibrations when the engine is deactivated and the improvement of the service life or reduction in noise during meshing, i.e. meshing either takes place whenever the engine comes to a standstill or meshing occurs only if a starting request (to return the internal combustion engine to the self-sustaining operating mode) is already present when the engine is coasting to a standstill.

On the other hand it is to be borne in mind that between the necessary functionality, in particular in the case of separate starting of the starter, co-ordination is carried out with the duration of the restarting when a starting request is present when the engine is coasting to a standstill. In addition, various strategies can be selected in accordance with the time of triggering of the starting request when the internal combustion engine is coasting to a standstill. It is therefore possible to select, for example, whether the meshing occurs at various rotational speeds of the internal combustion engine which are still positive or already during the swinging back. Here, the time is defined on the basis of the functionality of the starting system.

SUMMARY OF THE INVENTION

The method according to the invention for meshing a meshing pinion of a starting device in a ring gear of an internal combustion engine has the advantage that particularly gentle meshing of the starter pinion in the ring gear is possible by moving the starter pinion in the direction of the ring gear by means of a pre-meshing force in a method step while the internal combustion engine is coasting to a standstill after being deactivated, until said starter pinion touches said ring gear, and then in a further method step a meshing force applied to the starter pinion in order to mesh the starter pinion in a tooth gap of the ring gear.

Further advantages can be found in the claims. If meshing of the starter pinion takes place at a time at which the driveshaft of the internal combustion engine is at a rotational speed which is zero after the internal combustion engine has been switched off, particularly gentle meshing in a tooth gap of the ring gear is possible. In this context, the situation after which a rotational speed of the driveshaft is zero can be a first time or another subsequently occurring time after the internal combustion engine has been switched off.

Gentle meshing is also possible as a result of this. In addition, meshing of the starter pinion in such a situation would be possible early compared to meshing after a definite stationary state of the driveshaft, and therefore a rapid restart of the internal combustion engine would be possible. If the time or times at which the rotational speed is set at zero is/are determined by calculation in advance, the advancing of the starter pinion and the application of the starter pinion to the ring gear, or placing in contact of said starter pinion with the ring gear, can be set directly to the event at which the driveshaft is at the rotational speed zero. This means that advancing or application of the starter pinion is set to the corresponding event and does not already occur, for example, two or three zero passes beforehand. This "punctual" application of the starter pinion has the advantage that possible undesired collisions between teeth of the starter pinion and teeth of the ring gear (rattling) is reduced as far as possible and as a result wear is minimized. Accordingly, it is also advantageous that the generation of the pre-meshing force is calculated in advance. According to a further claim there is provision that the method step in which the starter pinion which is not being driven by the starter motor is advanced in the direction of the ring gear by means of a pre-meshing force using a pre-meshing actuator after the internal combustion engine has been switched off and before a first or second time at which the driveshaft of the internal combustion engine reaches the rotational speed zero or not until after the driveshaft has reached an angular acceleration with an absolute value of zero. This provides the advantage that the contact time between the starter pinion and the ring gear is particularly short.

According to a further embodiment of the invention there is provision that the method according to which a meshing force is selectively applied to the starter pinion in order to mesh the starter pinion in a tooth gap of the ring gear is carried out whenever the internal combustion engine is switched off. This potentially brings about a situation in which the possibility of revving up the internal combustion engine with maximum speed is provided.

According to a further embodiment of the invention there is provision that the method step just mentioned takes place only if a controller of the internal engine receives a starting signal, after which the internal combustion engine is to be returned to the self-sustained engine operating mode for driving a vehicle. This has the advantage that, on the one hand, there is saving in energy since there are no cases in which a further self-sustaining operating mode is not necessary afterwards, and, on the other hand, the gear mechanism or the starter pinion and the ring gear are treated gently at this point (less wear).

BRIEF DESCRIPTIONS OF THE DRAWINGS

Figure 1B:
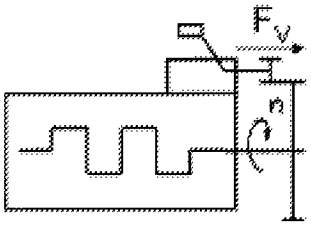
Figure 1A:
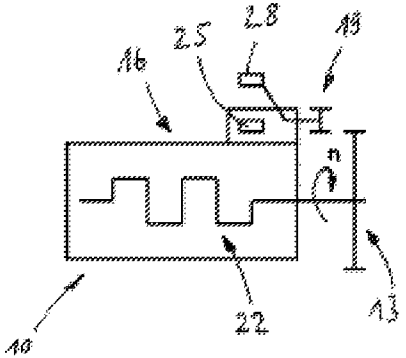
Figure 3:
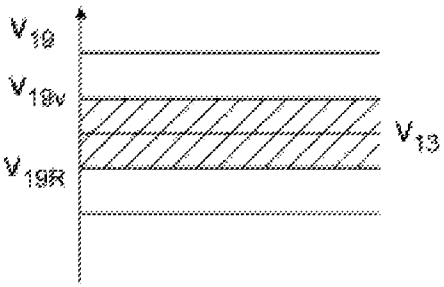
Figure 2:
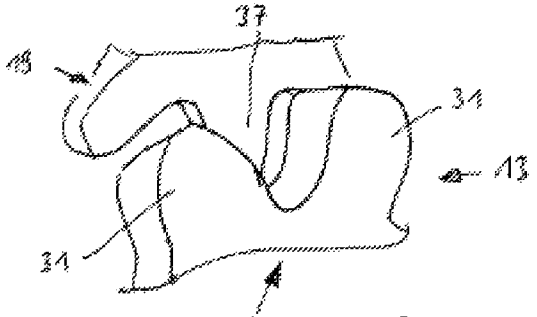
Figure 4:
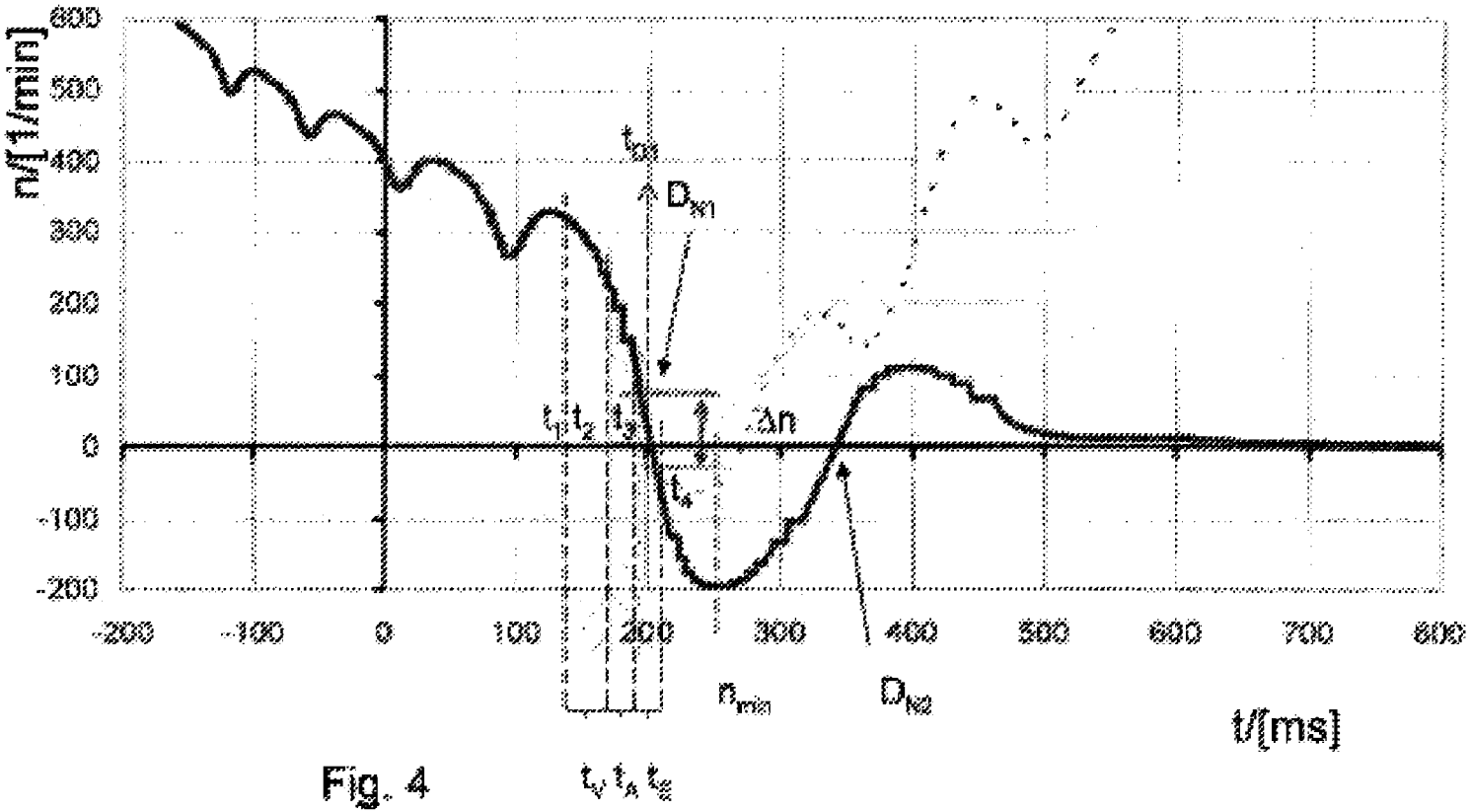
Figure 5:
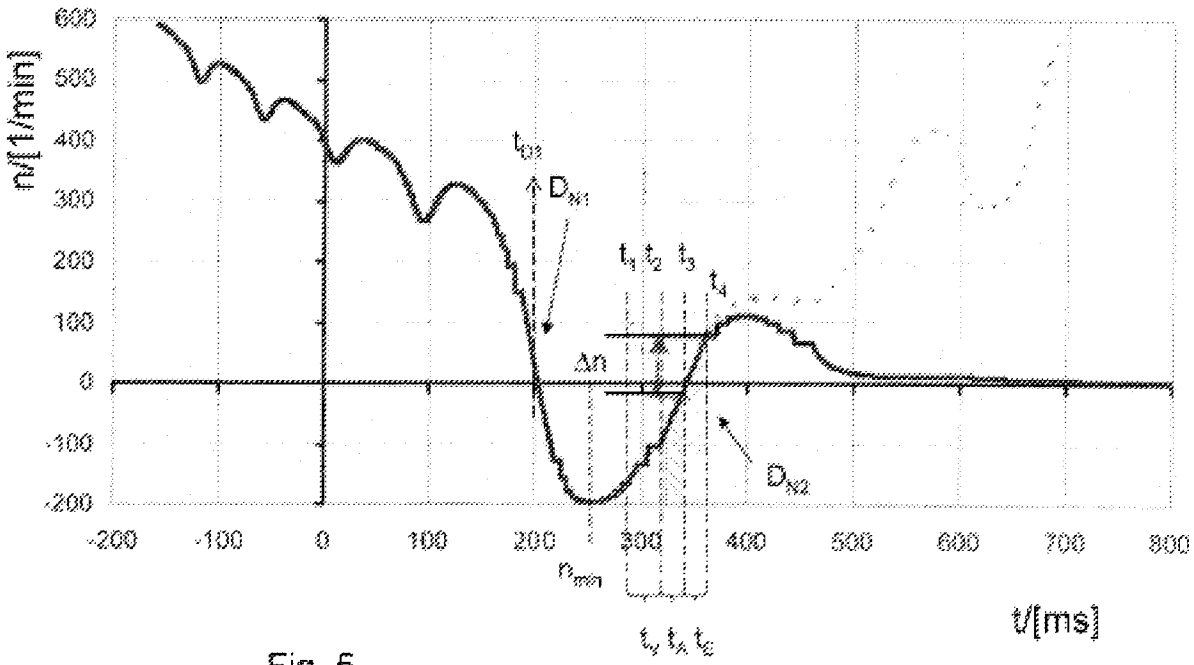
Figure 6:
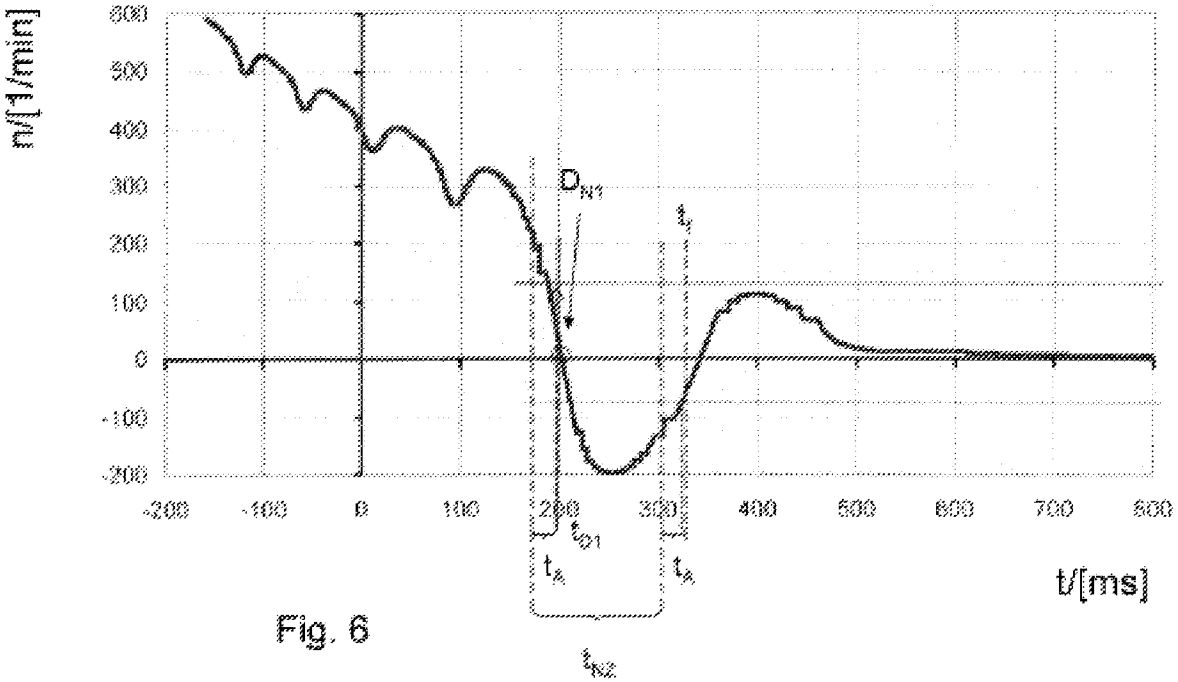

The invention will be explained in more detail below by way of example with reference to the figures, of which:

FIGS. 1*a* to 1*c* show a schematic illustration of an internal combustion engine having a starting device in three different situations, FIG. 2 shows a detail of a ring gear with a starter pinion arranged in front of the latter, FIG. 3 shows possible rotational speed situations between the ring gear and the starter pinion in four fields, FIG. 4 shows the rotational speed ranges of the driveshaft in which meshing with the non-rotating starter pinion can occur, FIG. 5 shows a further rotational speed diagram with the timing relationships at the second zero crossover and FIG. 6 shows a further rotational speed diagram.

DETAILED DESCRIPTION

An internal combustion engine 10 which has a ring gear 13 is illustrated in FIGS. 1*a* to 1*c*. A starting device 16, which has a starter pinion 19, is located right next to the internal combustion engine 10. The ring gear 13 of the internal combustion engine 10 is driven by a driveshaft 22. A starter motor 25 which is mounted on the starting device 16 drives the starter pinion 19. A pre-meshing actuator 28, embodied for example as a starter relay (lifting magnet with electrical switching function) or only as a lifting magnet is suitable for advancing the starter pinion 19 in the direction of the ring gear and for then meshing it in a tooth gap of the ring gear 13 in a further method step.

FIG. 1*a* shows the situation in which the internal combustion engine 10 has a still rotating driveshaft 22 which, as is customary, has a variable rotational speed n. Since the internal combustion engine is already switched off and the driveshaft 22 is still rotating, the latter is in the so-called coasting to a standstill mode. Rotational speed n changes macroscopically, i.e. the mean value of the rotational speed n drops more or less quickly to zero. In this context, more relative minimum values and maximum values are usually formed. The starter pinion 19 is not meshed in the ring gear 13. The method step S1, the switching off of the internal combustion engine 10 has already taken place.

FIG. 1*b* illustrates how the starter pinion 19, which is not driven by the starter motor 25, is advanced in the direction of the ring gear 13 by means of a pre-meshing force $F_V$ using the pre-meshing actuator 28, until said starter pinion 19 touches said ring gear 13 or is applied thereto.

FIG. 1*c* illustrates how according to the further method step S3 a meshing force $F_E$ is selectively applied to the starter pinion 19 in order to mesh the starter pinion 19 into a tooth gap of the ring gear 13.

FIG. 2 illustrates a detail of a ring gear 13. The latter has teeth 31 arranged around the circumference and a tooth gap 34 arranged between every two teeth 31. Here, a detail of a starter pinion 19 with a tooth 37 is also illustrated in the background. This tooth 37 is fitted into the tooth gap 34.

Accordingly, a method for meshing a starter pinion 19 of a starting device 16 into a ring gear 13 of an internal combustion engine 10 is disclosed, wherein the internal combustion engine 10 has a driveshaft 22, and the starting device 16 has a starter motor 25, wherein the driveshaft 22 has a variable rotation speed n, and in a method step S1 the internal combustion engine 10 is switched off, and as a result in a method step S2 the starter pinion 19, which is not driven in rotation by the starter motor 25, is advanced in the direction of the ring gear 13 by means of a pre-meshing force $F_V$ using a pre-meshing actuator 28, until said starter pinion 19 touches said ring gear 13 or bears thereon, and afterwards in a further method step S3 a meshing force $F_E$ acts selectively on the starter pinion 19 in order to mesh the starter pinion 19 in a tooth gap 34 of the ring gear 13.

FIG. 3 illustrates various possible rotational speed situations between ring gear 13 and the starter pinion 19. The central line shows an assumed circumferential speed $V_{13}$ of the ring gear 13 of the internal combustion engine 10. Above this line it is indicated that the circumferential speed $V_{19}$ of the starter pinion 19 is higher than the circumferential speed $V_{22}$ of the ring gear 22. Below this line it is indicated that the circumferential speed of the starter pinion 19 is lower than that of the ring gear 13. A range which is not specified here in terms of absolute value can be seen respectively above and below the line, both below and above the circumferential speed $V_{22}$. The line $V_{19V}$ indicates the maximum circumferential speed of the starter pinion 19 at which it is still possible for the starter pinion 19 to mesh into the ring gear 13. The lower line $V_{19R}$ shows the lower circumferential speed of the starter pinion 19, which also permits meshing into the ring gear 13. Speed ratios which lie above or below these lines $V_{19V}$ make meshing impossible. This gives rise to the known phenomenon of rattling (teeth of the ring gear 13 and teeth 37 of the starter pinion 19 slide on each other).

FIG. 4 illustrates coasting of the driveshaft 22 to a standstill. The associated fluctuations in rotational speed run alternately, forming a relative minimum and maximum value. The driveshaft as illustrated in FIG. 4 usually reaches a first zero crossover at $D_{N1}$ after a number of piston strokes, it is therefore a piston machine, with the result that the driveshaft 22 remains stationary for a moment and then reverses its sense of rotation in order to finally run through a negative rotational speed of the maximum value (equal to the rotational speed minimum value $n_{min}$), in order to become slower again in terms of absolute value so as to reach a further zero crossover $D_{N2}$ and assume again the original sense of rotation which follows the zero crossover $D_{N2}$. The rotational speed $n_{22}$ of the driveshaft then approaches the value zero asymptotically.

The method occurs here in such a way that when the internal combustion engine is switched off, or shortly thereafter, the rotational speed of the driveshaft 22 is observed and analyzed in order to determine the time of the first zero crossover $D_{N1}$. The "observing" and "analyzing" corresponds here to the determination of a prediction as to how the rotational speed profile of the driveshaft 22 develops over time t. Starting from this time $t_{D1}$, back calculation is carried out to determine how much time is required for the meshing (time $t_E$), how much time is required for the application or the duration thereof ($t_A$) and how much time $t_V$ is necessary for the pre-meshing. As a result of this back calculation a time $t_1$ is obtained from which the advancing of the starter pinion is brought about. Taking this time $t_1$ as a starting point, the starter pinion 19 is advanced, starting from the time $t_2$ it is applied to the ring gear 13 during the period $t_A$, and afterwards during the time $t_E$ it is meshed in the ring gear 13. During the application, a differential rotational angle between the pinion and the ring gear is passed through, said angle corresponding to at least one inter-tooth distance. For this it is necessary for the geometry of the pinion and the ring gear as well as the pinion dynamics (pinion mass generated advancing force by means of the meshing actuator and a spring) to ensure a sufficiently large rotational speed window for the meshing process. Furthermore, the rotational speed gradients of the internal combustion engine 10 and the starter or starting device 16 must permit the necessary relative rotational angle to be passed through. For this purpose it is necessary to ensure, under certain circumstances, that the starting device is not yet starting the starter pinion 19.

The phase "applied" starting from the time $t_2$ can already take place before the rotational speed window is reached, a so-called "early application". In this context it is necessary to ensure that the rotational speed window which permits meshing is reached. The dotted line indicates a possible increase in the rotational speed of the driveshaft 22 which can occur after a successful start.

The illustration in FIG. 5 is concerned with the chronological relationships around the second zero crossover DN2. The time tD2 at which the zero crossover DN2 is expected is also predicted here. From this time, a portion of the meshing duration, the application time and the pre-meshing time is calculated back, as has already been done with respect to the first zero process, in order to determine the time $t_1$ at which the starter pinion 19 is to be pre-meshed. Starting from $t_1$, the starter pinion 19 is pre-meshed until at the time $t_2$ it bears against the ring gear 13 for the duration tA. Starting from t3, the meshing process of the starter pinion 19 in the ring gear 13 begins. The same conditions apply to this meshing process as have already been indicated for the first zero process.

If the design and the controller of the internal combustion engine ensure that the rotational speed window for reliable meshing after the second rotational speed reversal DN2 is no longer exceeded, meshing can occur at the first zero crossover and starting at a second zero crossover in the swinging back phase of the internal combustion engine. This means that the application of the starter pinion 19 to the ring gear 13 of the internal combustion engine can occur starting from a certain time period for the process before the first zero crossover is reached, provided that a certain time window is assumed during the actuation, cf. FIG. 6.

FIG. 6 illustrates how the time period arises at which no actuation of the pre-meshing actuator 28 is permissible. If the time of the predicted first zero crossover tD1 is used as a starting point and if the duration of application to is calculated back, the start of the time from which actuation of the pre-meshing actuator 28 is no longer permissible is obtained. The end of this time period tNZ is obtained by means of the permissible rotational speed window around the zero crossover, and hereby by the minimum permissible rotational speed before the second zero crossover. Starting from this time tF, the time of the provided application of the starter pinion 19 is to be in turn deducted. This then yields the time at which the pre-meshing actuator must not be actuated in order to achieve reliable meshing.

If additionally the condition that the rotational speed of the driveshaft 22 does not leave the rotational speed window for reliable meshing during the swinging back, i.e. the low point of the rotational speed curve is above the lower rotational speed limit, meshing can even occur starting with the meshing at the first zero crossover in the complete swinging back phase of the internal combustion engine. The dotted line shows a possible increase in the rotational speed of the driveshaft 22 which can occur after a successful start.

According to the descriptions of FIGS. 4 and 5 there is provision that meshing of the starter pinion 19 takes place at a time t1 or tD2 at which the driveshaft 22 of the internal combustion engine 10 has a rotational speed n which is zero after the internal combustion engine 10 has been switched off. Accordingly there is provision that the rotational speed is set at equal to zero a first time or a further time occurring thereafter. As has been mentioned with respect to the two zero crossovers, there is provision that a time tD1, tD2 at which the rotational speed n zero is set is determined by calculation in advance. Accordingly there is also provision for the other pinion 19 to be advanced in the direction of the ring gear 13 by means of the pre-meshing force $F_V$ after the calculation in advance. The method step S3 occurs after the internal combustion engine 10 has been switched off and before a first or second time tD1, tD2 at which the driveshaft 22 of the internal combustion engine 10 reaches the rotational speed n which is equal to zero or only after the driveshaft 22 has reached an angular acceleration with an absolute value of zero. The situation at which the driveshaft 22 has the angular acceleration with an absolute value of zero is the region in which the driveshaft 22 is stationary. According to one variant of the method there is provision that the method step S3 after which the starter pinion 19 selectively experiences a meshing force FE occurs whenever the internal combustion engine 10 is switched off. Alternatively, the step S3 can also occur only when a controller of the internal combustion engine 10 receives a starting signal, after which the internal combustion engine is to be then returned to the self-sustaining engine operating mode for driving a vehicle.

The invention claimed is:

1. A method for meshing a starter pinion (19) of a starting device (16) into a ring gear (13) of an internal combustion engine (10), wherein the internal combustion engine (10) has a driveshaft (22) and the starting device (16) has a starter motor (25), wherein the driveshaft (22) has a variable rotation speed (n), and in a method step (S1) the internal combustion engine (10) is switched off and then in a method step (S2) the starter pinion (19), which is not driven in rotation by the starter motor (25), is advanced by a pre-meshing force (FV) using a pre-meshing actuator (28), in a direction of the ring gear (13), and then in a further method step (S3) a meshing force (FE) is selectively applied to the starter pinion (19) in order to mesh the starter pinion (19) in a tooth gap (34) of the ring gear (13) during a time period (tE), characterized in that the starter pinion (19) is advanced in the direction of the ring gear (13) by the pre-meshing force (FV) until the starter pinion (19) touches the ring gear (13), and then starting from a time (t2) the starter pinion (19) is applied to the ring gear (13) during a time period (tA), wherein the meshing of the starter pinion (19) takes place up to a time (tD1, tD2) at which the driveshaft (22) of the internal combustion engine (10) has, after the switching off of the internal combustion engine (10), a rotational speed (n) which is zero, and thereby a zero crossover occurs during the time period (tE) of the meshing at the rotational speed (n) of the driveshaft (22).

2. The method as claimed in claim 1, characterized in that the rotational speed (n) is set at zero a first time or a further time occurring thereafter.

3. The method as claimed in claim 2, characterized in that a time (tD1, tD2) at which the rotational speed (n) is set at zero is determined by pre-calculation.

4. The method as claimed in claim 3, characterized in that the starter pinion (19) is advanced in the direction of the ring gear (13) by the pre-meshing force (FV) after the pre-calculation.

5. The method as claimed in claim 1, characterized in that the method step (S2) occurs after the internal combustion engine (10) has been switched off and before a first or second time (tD 1, tD2) at which the driveshaft (22) of the internal combustion engine (10) reaches the rotational speed (n) zero, or not until after the driveshaft (22) has reached an angular acceleration with an absolute value of zero.

6. The method according to claim 1, characterized in that the method step (S3) takes place whenever the internal combustion engine (10) is switched off.

7. The method as claimed in claim 1, characterized in that the method step (S3) takes place only if a controller of the internal combustion engine (10) receives a starting signal, after which the internal combustion engine (10) is to be returned to the self-sustained engine operating mode for driving a vehicle.

8. The method as claimed in claim 4, characterized in that the method step (S2) occurs after the internal combustion engine (10) has been switched off and before a first or second time (tD 1, tD2) at which the driveshaft (22) of the internal combustion engine (10) reaches the rotational speed (n) zero, or not until after the driveshaft (22) has reached an angular acceleration with an absolute value of zero.

9. The method according to claim 8, characterized in that the method step (S3) takes place whenever the internal combustion engine (10) is switched off.

10. The method as claimed in claim 9, characterized in that the method step (S3) takes place only if a controller of the internal combustion engine (10) receives a starting signal, after which the internal combustion engine (10) is to be returned to the self-sustained engine operating mode for driving a vehicle.

* * * * *